United States Patent [19]

Najjar et al.

[11] Patent Number: 4,808,194

[45] Date of Patent: Feb. 28, 1989

[54] STABLE AQUEOUS SUSPENSIONS OF SLAG, FLY-ASH AND CHAR

[75] Inventors: Mitri S. Najjar; Farrokh Yaghmaie, both of Hopewell Junction; Louis S. Sorell, Fishkill, all of N.Y.

[73] Assignee: Texaco Inc., White Plains, N.Y.

[21] Appl. No.: 674,898

[22] Filed: Nov. 26, 1984

[51] Int. Cl.[4] ..... C10L 1/32

[52] U.S. Cl. ..... 44/51

[58] Field of Search ..... 44/51; 48/DIG. 7, 197

[56] References Cited

U.S. PATENT DOCUMENTS

| | | | |
|---|---|---|---|
| 4,094,810 | 6/1978 | Thomas | 44/51 |
| 4,104,035 | 8/1978 | Cole et al. | 44/51 |
| 4,145,189 | 3/1979 | Solbakken | 44/51 |
| 4,304,572 | 12/1981 | Wiese et al. | 44/51 |
| 4,392,865 | 7/1983 | Grosse et al. | 44/62 |
| 4,443,230 | 4/1984 | Stellaccio | 48/DIG. 7 |
| 4,475,924 | 10/1984 | Meyer | 44/51 |
| 4,478,603 | 10/1984 | Mark | 44/51 |

*Primary Examiner*—William R. Dixon, Jr.
*Assistant Examiner*—Margaret B. Medley
*Attorney, Agent, or Firm*—Robert A. Kulason; James J. O'Loughlin; Albert Brent

[57] ABSTRACT

A pumpable aqueous suspension of slag, fly-ash, char, and mixtures thereof which contains a surfactant and has a reduced viscosity and increased resistance to sedimentation. The aqueous suspension is produced by quench cooling and/or scrubbing a raw effluent gas stream from the partial oxidation of solid carbonaceous fuel. It may have a solids content of about 1.0 to 50.0 weight percent. The surfactant comprises an anionic or nonionic adduct of an alkyl phenol and polyoxyethylene or polyoxypropylene. In one embodiment, a solid carbonaceous fuel is wet ground with the aforesaid aqueous suspension and make-up water, if any, to produce a stable aqueous slurry feed to the partial oxidation gas generator.

5 Claims, No Drawings

STABLE AQUEOUS SUSPENSIONS OF SLAG, FLY-ASH AND CHAR

FIELD OF THE INVENTION

This invention relates to stable aqueous suspensions of particulate matter selected from the group consisting of slag, fly-ash, char, and mixtures thereof which are produced in the partial oxidation process. More particularly, it pertains to novel pumpable stabilized aqueous suspensions of particulate matter selected from the group consisting of slag, fly-ash, char, and mixtures thereof that are produced by quench cooling and/or scrubbing a raw effluent gas stream from a process for the partial oxidation of solid carbonaceous fuel.

Solid carbonaceous fuels such as coal, petroleum coke, shale, asphalt, etc. have been dispersed in liquid mediums such as water and liquid hydrocarbons to form pumpable slurries. These slurries have been introduced as feedstock into partial oxidation gas generators in processes disclosed for example in coassigned U.S. Pat. Nos. 3,544,291; 3,620,698; 4,104,035; 4,265,407; and 4,328,008.

Various additives for dispersing coal in water are described in coassigned U.S. Pat. No. 4,104,035 and also in U.S. Pat. No. 4,358,293. However, the slurry compositions described therein differ substantially from the subject novel stable aqueous suspensions of particulate matter selected from the group consisting of slag, fly-ash, char, and mixtures thereof. Unexpectedly and advantageously, the aqueous suspensions of the subject invention have reduced sedimentation rates as well as reduced viscosities in comparison with conventional slurries.

SUMMARY OF THE INVENTION

In accordance with the invention there is provided a pumpable stable aqueous suspension of particulate matter. The particulate matter is produced when solid carbonaceous fuel is gasified in a partial oxidation gas generator to produce a raw effluent gas mixtures of $H_2+CO$ and is selected from the group consisting of slag, fly-ash, char, and mixtures thereof. The aqueous suspension is produced by quench cooling and/or scrubbing the raw efluent gas stream with water. The aqueous suspension has a reduced viscosity and increased resistance to sedimentation. It may have a solids content of about 1.0 to 50.0 weight percent of particulate matter selected from the group consisting of slag, fly-ash, char, and mixtures thereof; about 0.1 to 10.0 weight percent (basis weight of the particulate matter) of a surfactant comprising an anionic or nonionic adduct of an alkyl phenol and polyoxyethylene or polyoxypropylene, said surfactant having structural Formula I, as follows:

$$R-P-O-(A)_y-(B)-M \qquad \text{I}$$

wherein:

R is an alkyl group with 9 to 24 carbon atoms; P—O— is a phenolic moiety in which O is oxygen, A is an ethoxy or propoxy group and y equals 5 to 39; and B is ($CH_2$—$CH_2$) when A is ethoxy or either $$-(CH(CH_3)-CH_2)- \text{ or } -(CH_2-CH(CH_3))-$$

when A is propoxy; and M is the terminating moiety and is selected from the group consisting of —OH, —$SO_3Na^+$, and —O—$SO_3Na^+$; and the balance of said suspension is water.

In another embodiment, a solid carbonaceous fuel is wet ground with the aforesaid aqueous suspension and make-up water, if any, to produce a stable aqueous slurry feed to the partial oxidation gas generator.

DISCLOSURE OF THE INVENTION

Synthesis gas, reducing gas and fuel gas comprising mixtures of $H_2$, CO and various amounts of other bases may be made by the partial oxidation process, such as described in coassigned U.S. Pat. Nos. 3,544,291, 3,998,609 and 4,289,502, which are incorporated herein be reference. Advantageously, the partial oxidation process may use as feedstock comparatively low-cost readily available ash-containing solid carbonaceous fuels. For example, the following ash-containing solid carbonaceous fuels are suitable feedstocks and include by definition: coal i.e. anthracite, bituminous, subbituminous, and lignite; particulate carbon; coke from coal; petroleum coke; coal liquefaction solid residues; oil shale; tar sands; asphaltic bitumen; and mixtures thereof. In the partial oxidation process, ground solid fuel is introduced into the gas generator either alone or in the presence of a substantially thermally vaporizable hydrocarbon and/or water, or entrained in a temperature moderator such as steam, $CO_2$, $N_2$ and recycle synthesis gas. The term free-oxygen containing gas, as used herein is intended to include air, oxygen-enriched air, i.e. greater than 21 mole % oxygen, and substantially pure oxygen, i.e. greater than 95 mole % oxygen (the remainder comprising $N_2$ and rare gases).

Entrained in the hot raw gas stream leaving the reaction zone of the gas generator at a temperature in the range of about 1700° to 3000° F. is particulate matter from the group comprising slag, fly-ash, char, and mixtures thereof. The particle size of said particulate matter is in the range of about 37 to 2000 microns, such as about 44 to 500 microns. The concentration of solids in the hot raw gas stream may be in the range of about 0.1 to 4 grams per standard cubic foot (SCF). The composition will depend upon the type of solid carbonaceous fuel and the temperature and operating conditions of the partial oxidation gas generator. By definition: fly-ash in the raw gas stream is the remnants of completely combusted particles of the solid carbonaceous fuel. The fly-ash particles in the hot gas stream have not reached the melting temperature of the mineral matter originally contained in the solid fuel. These fly-ash particles are typically about 37 microns and below in size. Fly-ash may contain in wt. % volatiles 5.0 to 20.0, fixed carbons 50–55; and mineral matter 30–35. Typical compositions of the mineral portions of fly-ash in the gas stream from a coal feed for example in wt. % follow: $SiO_2$58.8–62.6; $Al_2O_3$15.8–20.0; $Fe_2O_3$3.3–5.1; $TiO_2$0.8–1.4; CaO 5.3–7.6; MgO 0.5–1.6; $Na_2O$ 0.2–0.4; $K_2O$ 0.4–0.7; $P_2O_3$0.1–0.3; and $SO_3$0.9–3.2. Slag is substantially molten ash or molten ash which has solidified into glassy particles. Slag particles are remnants of completely burnt coal particles or slurry droplets and represent the fused mineral matter of the solid carbonaceous fuel feed. The content of mineral matter in a typical solid carbonaceous fuel in weight percent may be about 0.2 for petroleum coke and 20.0 for coal. The size of coarse solid particles of slag is greater than about 841 microns, such as up to about 2000 microns; and the size of fine solid particles of slag is a fraction thereof. Char is the devolatilized and partially combusted solid carbonaceous fuel particles consisting mainly of ash. The remainder of the char e.g. about 2–65 wt. % comprises carbon, and a little, if any, of hydrogen and sulfur. Char particles are porous and the size is typically below 841 microns. The particles have not reached the melting temperature of the mineral matter originally contained in the solid carbonaceous fuel. The amount of char in the effluent gas stream may be decreased by increasing the temperature of the reaction zone.

The hot raw effluent gas stream exits from the partial oxidation gas generator and may be cooled to a temperature in the range of about 60° to 950° F., such as less than about 350° F. For example, the hot gas stream may be first partially cooled by direct contact with water contained in a quench tank, such as shown in coassigned U.S. Pat. No. 4,218,423 which is incorporated herein by reference. Molten slag is solidified by the quench water and most of the fly-ash, slag and char are transferred to the water in the quench tank. The partially cooled gas stream may be then passed through a water scrubbing operation to remove any remaining entrained particulate matter. The pressure in the quench tank is substantially the same as the gas generator located above. A portion of the quench water at the bottom of the quench tank is removed by way of a lock hopper 37 and settler 40 as shown in the drawing for coassigned U.S. Pat. No. 3,544,291. The aqueous suspensions of particulate matter from the group consisting of slag, fly-ash, char, and mixtures thereof in lines 39, 41 and 42 of U.S. Pat. No. 3,544,291 have solids concentrations in the range of about 1.0 to 50.0 wt. %, such as about 10 to 20 wt. %. For example, the overflow stream in line 41 of the drawing in coassigned U.S. Pat. No. 3,544,291 may have a solids content of particular matter in the range of about 1.0–4.0 wt. % and a particle size in the range of about 37 to 2000 microns. The underflow in line 42 may have a solids content of particulate matter in the range of about 5 to 50 wt. % and a particle size of up to about 2000 microns or more. In one embodiment of the subject invention about 0.1 to 10.0 wt. % (basis weight of particulate matter) of a surfactant comprising an anionic or nonionic adduct of an alkyl phenol and polyoxethylene or polyoxypropylene (Formula I) to be further described, is mixed with said aqueous suspensions of particulate matter to produce a stable stream of aqueous suspension. In one embodiment, fresh solid carbonaceous fuel feed to the system may be wet ground with said pumpable aqueous suspension and make-up water, if any, to produce a stable aqueous slurry feed to the partial oxidation gas generator having a solids concentration in the range of about 50 to 75 wt. %. The stable slurry feed includes about 0.1 to 10.0 wt. % (basis weight of solid carbonaceous fuel and particulate matter) of said Formula I surfactant. Another stream of quench water carrying fine particles exits the gasifier quench chamber or pool of water 27 of U.S. Pat. No. 3,544,291 by way of line 43 in response to a liquid level controller and is directed to settler 40. The aqueous suspension in line 43 and the gas scrubbing water from line 31 may have about 0.2 to 4.0 wt. % solids substantially comprising fly-ash and char with a particle size in the range of about 37.0 to 1000 microns. On the way to the settler, the heat content of the aqueous suspension of particulate matter consisting of slag, fly-ash, char, and mixtures thereof may be reduced by indirect heat exchange in a heat exchanger (not shown). Advantageously by the subject invention, fouling of tubes and heat exchanger surfaces by the particulate matter precipitating out is avoided. Alternatively, the hot raw effluent gas stream from the reaction zone may be partially cooled, by indirect heat exchange, prior to being scrubbed with water, by being passed through a radiant or convection gas cooler. Ash and coarse and fine particles of slag and char may pass from the water sump of the gas cooler and are collected in a lock hopper vessel, such as shown in coassigned U.S. Pat. No. 4,377,132 which is incorporated herein by reference. The solids and water from the lock hopper may flow by gravity into a water sump or settler where optionally the coarse particulate solids may be removed by screens thereby producing a dispersion of fine particulate solids as described previously.

The quench cooling water, scrubbing water, or both comprising water suspensions having a solids content in the range of about 0.2 to 5.0 wt. %, such as about 1.0 to 2.0 wt. % of particulate solids from the group fly-ash, slag, char, and mixtures thereof as previously described are combined or separately treated in the subject process. The water suspension at a temperature in the range of about 60° to 700° F., and a pressure in the range of about 1 to 250 atmospheres is mixed with the water soluble anionic or nonionic surfactant.

Mixing of the dispersions of particulate solids from the group fly-ash, slag, char, and mixtures thereof in quench and/or scrubbing water with the anionic or nonionic surfactant may take place in the following manner: (1) in a gravity settling tank or clarifier, at a temperature in the range of about 60° to 250° F., such as about 150° to 200° F., (2) in the quench water tank located below the reaction zone of the partial oxidation gas generator, at a temperature in the range of about 50° to 700° F., such as about 250° to 450° F., or (3) by means of a static mixer located in a pipeline leading to a settler or other conventional solids-liquid separator, at a temperature in the range of about 60° to 250° F., such as about 150° to 200° F. The in-line static mixer comprises a free-flow cylindrical conduit which encloses a plurality of fixed helical-shaped curved sheet-like elements that extend longitudinally in series. Flow division and radial mixing occur simultaneously within the conduit. There are no moving parts nor external power requirements.

The subject invention deals with stable aqueous suspension of particulate matter selected from the group consisting of slag, fly-ash, char, and mixtures thereof which contain a surfactant and are pumpable and have a low viscosity and reduced sedimentation rate in comparison with other aqueous suspensions of said particulate matter with the same solids content but without a surfactant. A stable suspension of said particulate matter in water is desired for transportation and processing. Fast sedimentation of slag and ash particles can cause operational difficulties. The excellent pumpability of the subject suspensions permits them to be transported long distances by pipeline without the solids settling out. The suspensions make excellent additives for ash-containing solid carbonaceous fuels for boilers and improved feedstocks for the partial oxidation process. The particulate matter will combine with the ash in the solid carbonaceous fuel to produce a low melting eutectic. By this means the gasifier may be run at a lower temperature, thereby extending the life of the refractory lining the reaction zone. Further, the particulate matter will not settle out and clog the narrow passages in the heat exchangers.

To maintain a high combustion efficiency and to reduce oxygen consumption in the above said partial oxidation process, it is necessary for the slurry feed to be uniform and the solids content to be high. When excess water is present in the feed slurry, valuable energy, e.g. heat, is lost in vaporizing the water and less solid carbonaceous fuel is converted into synthesis gas. For maximum combustion efficiency, the solid fuel particles must be highly dispersed in a limited amount of the water carrier. Since the hydrophobicity of medium to high rank solid fuels is high, but for the subject invention particles of these solid fuels would settle out rapidly from quiescent aqueous dispersion thereby reducing the combustion efficiency. By adding the subject aqueous suspensions of particulate matter selected from the group consisting of slag, fly-ash, char, and mixtures thereof to slurries of solid carbonaceous fuel and water, it was unexpectedly found that not only is there a substantially increased resistance to sedimentation of the solid fuel particles but the solids content of the slurry may be increased 25 wt. % or more while the viscosity may be substantially reduced to provide a greatly improved pumpable slurry of solid fuel. Further, the particulate matter selected from the group consisting of slag, fly-ash, char and mixtures thereof combines with the ash in the solid carbonaceous fuel to produce a low temperature eutectic. The gas generator may be run in the slagging mode at a lower temperature, thereby extending the life of the refractory liner reaction zone.

The moisture content of the solid carbonaceous fuel particles is in the range of about 0 to 25 wt. %, such as about 0.5 to 10 wt. %. Predrying may be required in some instances to reach these levels.

The comminuted solid carbonaceous fuel has a particle size of less than ASTM E-11 Alternate Sieve Designation No. 14 e.g. 1400 microns. In one embodiment, the solid carbonaceous fuels are preferably ground to a particle size so that 99.9 wt. % of the material passes through an ASTM Ell Sieve Designation Standard 1.40 mm (Alternative No. 14), 99.5 wt. % of the material passes through an ASTM Ell Sieve Designation Standard 425 μm (Alternative No. 40), and at least 50 wt. % of the material passes through an ASTM Ell Sieve Designation STandard 45 μm (Alternative No. 325). 1000 μm=1 mm.

Preferably, any suitable conventional ball or rod mill may be used to grind the raw solid carbonaceous fuel and/or if necessary the slag, fly-ash or char to the desired particle size. Preferably, the solid fuel is wet ground with water so that a ground slurry product is produced having the right solids concentration. In one embodiment, about 0.1 to 10.0 wt. % (basis weight of particulate matter and solid fuel) of the surfactant is added during the wet grinding stage. Alternatively, the solid fuel and/or if necessary the slag, fly-ash, char, or mixtures thereof are ground dry and then mixed with water and surfactant. Optionally, the surfactant may be added while the solid fuel water slurry is being held in a holding tank.

The surfactant comprises an anionic or nonionic adduct of an alkyl phenol and polyoxyethylene or polyoxypropylene having structural Formula I, as follows:

$$R—P—O(A)_y(B)M \qquad \text{I}$$

wherein:

R is an alkyl group with 9 to 24 carbon atoms; P—O— is a phenolic moiety in which O is oxygen, A is an ethoxy or propoxy group and y equals 5 to 39; B is ($CH_2$—$CH_2$) when A is ethoxy; and either $$\left(\begin{array}{c} CH—CH_2 \\ | \\ CH_3 \end{array}\right) \text{ or } \left(\begin{array}{c} CH_2—CH \\ | \\ CH_3 \end{array}\right)$$

when A is propoxy; and M is the terminating moiety and is selected from the group consisting of —OH, —$SO_3Na^+$, and —O—$SO_3Na^+$.

A preferred embodiment is produced by the following reaction:

$$C_9H_{19}C_6H_4OH + 40C_2H_4O \rightarrow C_9H_{19}C_6H_4O(CH_2CH_2O)_{40}H$$

It is suggested that the aforesaid surfactant is adsorbed on the surface of the particulate matter, such as slag, fly-ash, or char. Char, for example, is a heterogenous system and a combination of adsorption schemes may give a more complete representation of surfactant adsorption. The inorganic matter is intermixed with organic matter and consists mostly of clay material. The clay structure (silica-alumina) shows Lewis and Bronsted acidity. The presence of empty orbitals in alumina as electron acceptors is responsible for the Lewis acidity. The hydroxy groups of silica may add to its Bronsted acidity. Based upon these, two modes of adsorption may be proposed. Mode A pictures the nonionogenic groups being adsorbed on the char surface. Mode B, postulates adsorption of surfactants by the polar groups or groups capable of donating electrons or participating in hydrogen bonding.

The subject surfactants comprise a series of oxyethylene or oxypropylene oligomers with nonionic or anionic terminating groups. Preferably, these surfactants are products of nonyl phenol polymerization with ethylene or propylene oxides. By controlling the motor ratios of the oxides to the phenol, oligomers of various sizes are obtained. It was unexpectedly found that the number of repeating units is critical. y in Formula I must be at least 5 in order to avoid a thick slurry, the viscosity of which is not measurable. A gradual decrease in viscosity of the slurries was observed when y is 5 to 39. The lowest viscosity was obtained when higher molecular weight material were used. The theoretical molecular weight of these surfactants are in the range of about 484 to 1980. They are water soluble or at least water dispersible. No co-surfactant is required. Further, they are comparatively low in cost. Also, the subject surfactants drastically increase the dispersion of the particulate matter.

The solubility of the nonionic surfactants decreases with temperature. As the number of repeating units increases, the solubility (in water) increases. This can be explained in terms of hydrogen bonding association of either groups with water. In principle as the number of the repeating groups increases, the number of water molecules associating with a given chain increases, which in turn increases its solubility. With nonionic surfactants, the molecular weight of the polymer appears to be the controlling factor.

The adsorption mode of the nonioninc oligomer, based upon the chemistry of clay material can be explained. Since clay minerals (as most of the macerals are) contain Bronsted and Lewis acidity, the ether linkage may compete for adsorption better than the phenyl group. The oxygen can participate on hydrogen bonding with char surfaces or it can donate electron pairs to empty orbitals of alumina. As the number of the repeating units increases, the change of adsorption of oxyethylene chain increases. This leads to formation of a protective layer. Nonionic and anionic surfactants were found to be capable of reducing the viscosity of water suspensions of slag, fly-ash and char. As a result the alteration of the char surface properties is not expected to be due to the electrical properties of the surfactants. The surfactants are probably adsorbed via their ether linkages. The dispersion and viscosity-reducing properties of these surfactants are related to their chain length. There appears to be an optimum size which provides the desirable results.

With respect to the oligomers terminated with anionic polar groups, the molecular weight of the surfactant is not a controlling factor. Instead sulfate or sulfonate groups contribute to the overall process. The polar groups enhance the potential of low molecular weight oligomers as viscosity reducing agents. The oligomeric surfactants with strong anionic terminating group(s) were found to have better viscosity reducing properties than the nonionic surfactants with comparable chain length but without an anionic group. The viscosities of the suspension of particulate matter may be determined by a rotational viscometer at different shear rates. In general, there is a substantial reduction in viscosity when a small amount of the specified surfactant is mixed with the suspension. Further, the viscosity of the suspension falls off as the number of oxypolyalkylene groups or the molecular weight of the surfactant increase. The viscosity also falls off as the shear rate increases. From a practical point of view, the subject surfactants with a nonionic or anionic group are improved and superior surfactants for suspensions of particulate matter selected from the group consisting of slag, fly-ash, char, and mixtures thereof.

The following examples illustrate the subject invention and should not be construed as limiting the scope of the invention.

EXAMPLES

Aqueous suspensions of Texaco Coal Gasification Process (TCGP) slag, fly-ash, and char having a solids concentration of about 7.4 wt. % and having a particle size of ASTM E-11 Standard Sieve Designation 45 microns (−325 mesh) were studied with and without Formula I surfactant as produced by the reaction of a nonylphenol and ethylene oxide. The number of repeating ethoxy groups ranged from 6 to 40.

Batch settling tests were run on the suspensions with and without the surfactant Formula I. The results reported in Table I for suspensions without surfactant show that both TCGP slag from German Coal and TCGP Fly-ash settle out rapidly. For example, with coal slag the clear interface level drops to about 50% of the original level in 540 seconds. In comparison, it took 900 seconds for fly-ash without surfactant in the suspension to reach the same level. The sedimentation rates for the aqueous suspension of particulate matter were measured by means of a vertical column 10 cm high × 1 cm I.D. at room temperature. The height (cm) of supernatant fluid (clear water) above the level for the aqueous suspension of TCGP Slag from German Coal or TCGP Fly-ash was measured with time. In contrast, as shown in Table II, there was substantially no settling of solids with time for those suspensions of TCGP slag from German Coal or TCGP Fly-ash containing 1.8 percent by weight (basis weight of solid fuel) of the Formula I surfactant. Similar tests with other Formula I surfactants on TCGP slag, fly-ash, char, and mixtures thereof produce similar results.

TABLE I

| BATCH SETTLING (NO SURFACTANT) | | | |
|---|---|---|---|
| TCGP Slag From German Coal | | TCGP Fly-Ash | |
| Height of Interface - cm | Time Sec. | Height of Interface - cm | Time Sec. |
| 9.8 | 60 | 9.8 | 60 |
| 7.2 | 240 | 7.2 | 480 |
| 5.6 | 360 | 5.4 | 780 |
| 4.8 | 540 | 4.8 | 900 |
| 4.2 | 900 | 4.3 | 1200 |

TABLE II

| BATCH SETTLING (WITH FORMULA I SURFACTANT) | | | |
|---|---|---|---|
| Formula I Surfactant R = 9, A = ethoxy y | Type of Solids Suspended | Interface Height (cm) | Time (sec.) |
| 39 | TCGP Slag From German Coal | 9.8 | 60 |
| | | 9.8 | 540 |
| | | 9.8 | 1920 |
| 39 | TCGP Fly-ash | 9.8 | 60 |
| | | 9.8 | 600 |
| | | 9.8 | 1200 |
| 29 | TCGP Fly-ash | 9.8 | 60 |
| | | 9.8 | 600 |
| | | 9.8 | 1200 |
| 11 | TCGP Fly-ash | 9.6 | 60 |
| | | 9.6 | 600 |
| | | 9.6 | 3600 |
| 9 | TCGP Fly-ash | 9.8 | 60 |
| | | 9.8 | 600 |
| | | 9.8 | 900 |
| 5 | TCGP Fly-ash | 9.8 | 60 |
| | | 8.4 | 600 |
| | | 8.3 | 900 |

Other modifications and variations of the invention as hereinbefore set forth may be made without departing from the spirit and scope thereof, and therefore only such limitations should be imposed on the invention as are indicated in the appended claims.

We claim:

1. A pumpable aqueous suspension of particulate matter with reduced viscosity and increased resistance to sedimentation and having a particle size in the range of about 37 to 2000 microns as produced by quench cooling and/or scrubbing the hot raw effluent gas stream comprising $H_2+CO$ at a temperature in the range of about 1700° F. to 3000° F. from the partial oxidation of solid carbonaceous fuel selected from the group consisting of anthracite, bituminous, and lignite coal; particulate carbon; coke from coal; petroleum coke; coal liquefaction solid residues; oil shale; tar sands; asphaltic bitumen; and mixtures thereof; and wherein said aqueous suspension comprises about 1.0 to 50.0 weight percent of said particulate matter consisting of a mixture of slag, fly-ash, and char; about 0.2 to 10.0 weight percent basis weight of said particulate matter, of a nonionic or anionic surfactant having a theoretical molecular weight in the range of about 484 to 1980 and having structural Formula I, as follows:

$$R-P-O\left(A\right)_y\left(B\right)M \qquad \text{I}$$

wherein: R is an alkyl group with 9 to 24 carbon atoms, P—O is a phenolic moiety in which O is oxygen, A is an ethoxy or propoxy group and y equals 5 to 39; B is ($CH_2$—$CH_2$) when A is ethoxy and either $$\left(\underset{\underset{CH_3}{|}}{CH}-CH_2\right) \text{ or } \left(CH_2-\underset{\underset{CH_3}{|}}{CH}\right)$$

when A is propoxy; and M is the terminating moiety and is selected from the group consisting of —OH, —$SO_3Na^+$, and —O—$SO_3Na^+$; and the balance of said suspension is water.

2. The aqueous suspension of claim 1 wherein said particulate matter has a particle size in the range of about 44 to 500 microns.

3. A process for producing a stable pumpable aqueous slurry feed for a partial oxidation gas generator for the production of synthesis gas, reducing gas, or fuel gas comprising: wet grinding together to a particle size of less than 1400 microns the following materials to produce said aqueous slurry feed having a solids content in the range of about 50 to 75 wt. %, an increased resistance to sedimentation, and a reduced viscosity;

(i) a solid carbonaceous fuel selected from the group consisting of anthracite, bituminous, and lignite coal; particulate carbon; coke from coal; petroleum coke; coal liquefaction solid residues; oil shale; tar sands; asphaltic bitumen, and mixtures thereof, (ii) a stable pumpable aqueous suspension of particulate matter with reduced viscosity and increased resistance to sedimentation and having a solids content in the range of about 1–50 wt. %, said particulate matter having a particle size in the range of about 37 to 2000 microns as produced by quench cooling and/or scrubbing the hot raw effluent gas stream comprising $H_2+CO$ at a temperature in the range of about 1700° F. to 3000° F. from said gas generator, and said particulate matter consisting of a mixture of slag, fly-ash, and char; and wherein said aqueous suspension includes about 0.1 to 10.0 wt. % basis weight of solid carbonaceous fuel and particulate matter of a surfactant having a theoretical molecular weight in the range of about 484 to 1980 and having the following structural Formula I:

$$R-P-O\left(A\right)_y\left(B\right)M \qquad \text{I}$$

wherein: R is an alkyl group with 9 to 24 carbon atoms, P—O is a phenolic moiety in which 0 is oxygen, A is an ethoxy or propoxy group and y equals 5 to 39; B is ($CH_2$—$CH_2$) when A is ethoxy and either $$\left(\underset{\underset{CH_3}{|}}{CH}-CH_2\right) \text{ or } \left(CH_2-\underset{\underset{CH_3}{|}}{CH}\right)$$

when A is propoxy; and M is the terminating moiety and is selected from the group consisting of —OH, —$SO_3Na^+$ and —O—$SO_3NA^+$; and (iii) make-up water, if any.

4. The process of claim 3 wherein said solid carbonaceous fuel is ground to a particle size so that 99.9 wt. % of the material passes through an ASTM Ell Sieve Designation Standard 1.40 mm Alternative No. 14, 99.5 wt. % of the material passes through an ASTM Ell Sieve Designation Standard 425 μm Alternative No. 40, and at least 50 wt. % of the material passes through an ASTM Ell Sieve Designation Standard 45 μm Alternative No. 325.

5. The process of claim 3 wherein the particulate matter in (ii) has a particle size in the range of about 44 to 500 microns.

* * * * *